US007677719B2

(12) United States Patent
Nakashima et al.

(10) Patent No.: US 7,677,719 B2
(45) Date of Patent: Mar. 16, 2010

(54) INKJET RECORDING APPARATUS

(75) Inventors: Atsuhisa Nakashima, Nagoya (JP); Susumu Kuzuya, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 576 days.

(21) Appl. No.: 11/557,734

(22) Filed: Nov. 8, 2006

(65) Prior Publication Data

US 2007/0146455 A1 Jun. 28, 2007

(30) Foreign Application Priority Data

Nov. 8, 2005 (JP) ..... 2005-323311

(51) Int. Cl.
*B41J 2/01* (2006.01)

(52) U.S. Cl. ..... 347/104; 347/101; 347/42

(58) Field of Classification Search ..... 347/104
See application file for complete search history.

(56) References Cited

U.S. PATENT DOCUMENTS

| | | | | |
|---|---|---|---|---|
| 4,860,029 | A * | 8/1989 | Iseda | 347/218 |
| 5,767,875 | A | 6/1998 | Sawada | |
| 5,859,653 | A * | 1/1999 | Aoki et al. | 347/8 |
| 5,870,114 | A * | 2/1999 | Numata et al. | 347/16 |
| 6,234,605 | B1 | 5/2001 | Hilton | |
| 6,854,843 | B2 * | 2/2005 | Anami et al. | 347/104 |
| 6,964,464 | B2 * | 11/2005 | Usuda | 347/10 |
| 7,004,565 | B2 | 2/2006 | Suzuki et al. | |
| 2004/0021732 | A1 | 2/2004 | Bergen | |
| 2004/0056942 | A1 * | 3/2004 | Kobayashi | 347/111 |
| 2004/0212658 | A1 * | 10/2004 | Otsuki | 347/41 |

FOREIGN PATENT DOCUMENTS

| | | | |
|---|---|---|---|
| EP | 0023433 | A2 | 2/1981 |
| JP | H8310049 | A | 11/1996 |
| JP | 2003311953 | A | 11/2003 |
| WO | 90/14957 | A1 | 12/1990 |
| WO | 97/31781 | A1 | 9/1997 |

OTHER PUBLICATIONS

European Patent Office, European Search Report for related Patent Application No. EP 06023157 dated Nov. 27, 2007.

(Continued)

*Primary Examiner*—Matthew Luu
*Assistant Examiner*—Brian J Goldberg
(74) *Attorney, Agent, or Firm*—Baker Botts L.L.P.

(57) ABSTRACT

An inkjet recording apparatus includes a holding face, an inkjet head including plural nozzles arranged along a predetermined direction correspondingly with a predetermined resolution, a first moving mechanism which performs a first movement of moving at least one of the inkjet head and the holding member in a direction perpendicular to the predetermined direction, a second moving mechanism which performs a second movement of moving the holding member in the predetermined direction, and a first movement controlling unit which controls the first moving mechanism to perform the first movement first and second times. In the second time, the inkjet head and the holding member are moved in directions that are opposite to directions in the first time. A second movement controlling unit controls the second moving mechanism to, after the first movement for the first time, perform the second movement by one half of a distance corresponding to the predetermined resolution.

10 Claims, 10 Drawing Sheets

OTHER PUBLICATIONS

The State Intellectual Property Office of the People's Republic of China, Notification of First Office Action in related Chinese Application No. 200610143509.7 issued Sep. 5, 2008.

European Patent Office, Office Action in Patent Application No. EP 06023157.8 mailed Jan. 30, 2009. (Counterpart to above-captioned U.S. Patent Application.).

* cited by examiner

INKJET RECORDING APPARATUS

CROSS REFERENCE TO RELATED APPLICATION

This application claims priority from Japanese Patent Application No. 2005-323311, filed on Nov. 8, 2005, the entire subject matter of which is incorporated herein by reference.

TECHNICAL FIELD

Aspects of the present invention relate to an inkjet recording apparatus in which ink is ejected to a recording medium to perform printing.

BACKGROUND

JP-A-2003-311953 discloses an inkjet printer in which ink is ejected from a line-head type inkjet head extending in a main scanning direction, onto a sheet transported in a sub-scanning direction, thereby printing an image on the sheet. In the inkjet printer, plural pressure chambers for applying a pressure to the ink are formed in the inkjet head while being adjacently arranged in a matrix pattern and in a highly dense manner. Nozzles which correspond respectively to the pressure chambers are formed in an ink ejection face in a highly dense manner. Therefore, the printer can print a high-resolution image on the sheet.

SUMMARY

In the inkjet printer disclosed in JP-A-2003-311953, the inkjet head itself is configured as a type, which can print a high-resolution image. In order to print an image of higher resolution, pressure chambers, nozzles, and minute ink flow paths through which the pressure chambers are connected to the nozzles have to be provided more. It is troublesome and difficult to increase the number of these components. Also, the production cost is largely increased.

Aspects of the invention provide an inkjet recording apparatus, which can print an image of resolution that is higher than that corresponding to a nozzle interval in an inkjet head.

According to an aspect of the invention, there is provided an inkjet recording apparatus comprising: a holding member including a holding face which holds a recording medium; an inkjet head including a plurality of nozzles, which are arranged along a predetermined direction correspondingly with a predetermined resolution on an ink ejection face opposed to the holding face; a first moving mechanism which performs a first movement of moving at least one of the inkjet head and the holding member in a direction perpendicular to the predetermined direction; a second moving mechanism which performs a second movement of moving the holding member in the predetermined direction; a first movement controlling unit which controls the first moving mechanism to, during a printing operation on one recording medium, perform the first movement two times including first and second times, in the second time the inkjet head and the holding member being moved in directions that are opposite to directions in the first time; a second movement controlling unit which controls the second moving mechanism to, during the printing operation on one recording medium and after the first movement for the first time, perform the second movement by a distance which is one half of a distance corresponding to the predetermined resolution; and a print controlling unit which, during the first movement, controls the inkjet head to eject an ink toward the recording medium.

According to the configuration, the print controlling unit controls the inkjet head so as to, during the first movement for the first time, eject the ink toward the recording medium, so that an image of resolution corresponding to the nozzle interval in the inkjet head is formed on the recording medium. After the second movement is performed by the second moving mechanism, the print controlling unit controls the inkjet head so as to, during the first movement for the second time, eject the ink toward the recording medium. Therefore, an image of resolution (which is twice that corresponding to the nozzle interval) corresponding to one half of the nozzle interval in the inkjet head can be formed on the recording medium. The term "during the first movement" does not always mean that at least one of the inkjet head and the holding member is in the state of movement in a direction perpendicular to the predetermined direction, but also includes the case where, in intermittent movement, for example, the head is temporarily stopped. The resolution corresponding to the nozzle interval in the inkjet head is determined by the distance between intersections of a virtual line segment extending in the predetermined direction and plural straight lines which extend in parallel to one another from the centers of plural nozzles so as to be perpendicular to the virtual line segment.

According to another aspect of the invention, there is provided an inkjet recording apparatus comprising: a holding member including a holding face which holds a recording medium; an inkjet head including a plurality of nozzles, which are arranged along a predetermined direction correspondingly with a predetermined resolution on an ink ejection face opposed to the holding face; a first moving mechanism which performs a first movement of moving at least one of the inkjet head and the holding member in a direction perpendicular to the predetermined direction; a second moving mechanism which performs a second movement of moving the holding member in the predetermined direction; a first movement controlling unit which controls the first moving mechanism to, during a printing operation on one recording medium, perform the first movement n times (where n is an arbitrary natural number of 2 or more) in which the inkjet head and the holding member are moved in directions that are opposite to directions in the first movement that is previously performed; a second movement controlling unit which controls the second moving mechanism to, during the printing operation on one recording medium and after each of first movements for first to (n−1)-th times, perform the second movement in which a distance between an initial position and the holding member is one of (n−1) values, and to make the distances between the initial position and the holding member after the second movements different from one another, the (n−1) values being obtained by incrementing by 1/n of a distance corresponding to the predetermined resolution from 1/n of the distance to (n−1)/n of the distance; and a print controlling unit which, during the first movement, controls the inkjet head to eject an ink toward the recording medium.

According to the configuration, the print controlling unit controls the inkjet head so as to, during the first movement for the first time, eject the ink toward the recording medium, so that an image of resolution corresponding to the nozzle interval in the inkjet head is formed on the recording medium. After the second movement is performed by the second moving mechanism, the print controlling unit controls the inkjet head so as to, during the first movement for the second time, eject the ink toward the recording medium. This operation is performed n times, with the result that an image of resolution (which is n times that corresponding to the nozzle interval)

corresponding to 1/n of the nozzle interval in the inkjet head can be formed on the recording medium.

DETAILED DESCRIPTION

[Illustrative Aspects]

Hereinafter, illustrative aspects of the invention will be described with reference to the accompanying drawings.

Figure 1:
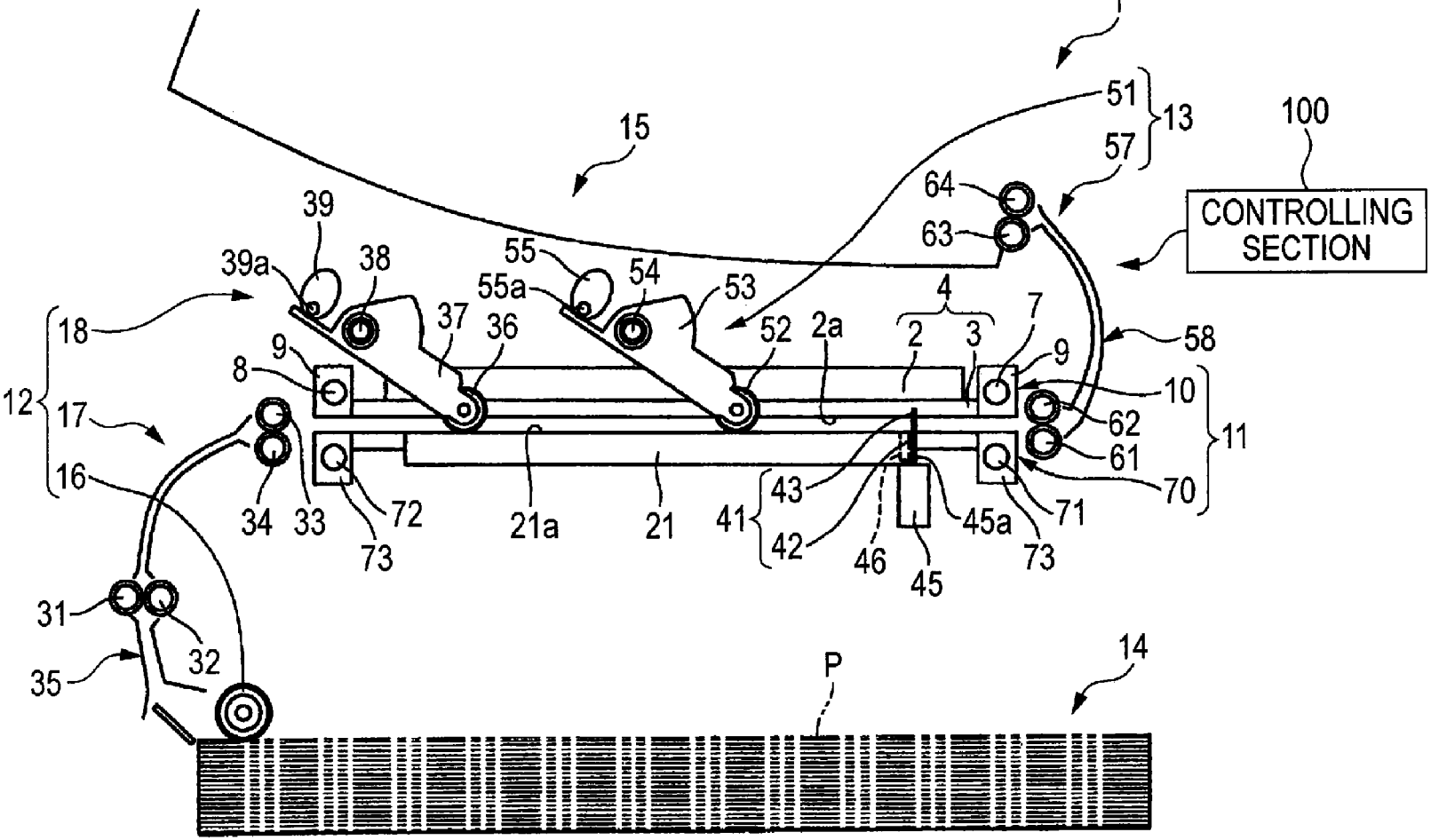
FIG. 1 is a configuration diagram showing an inkjet printer according to an aspect of the invention.
Figure 2:
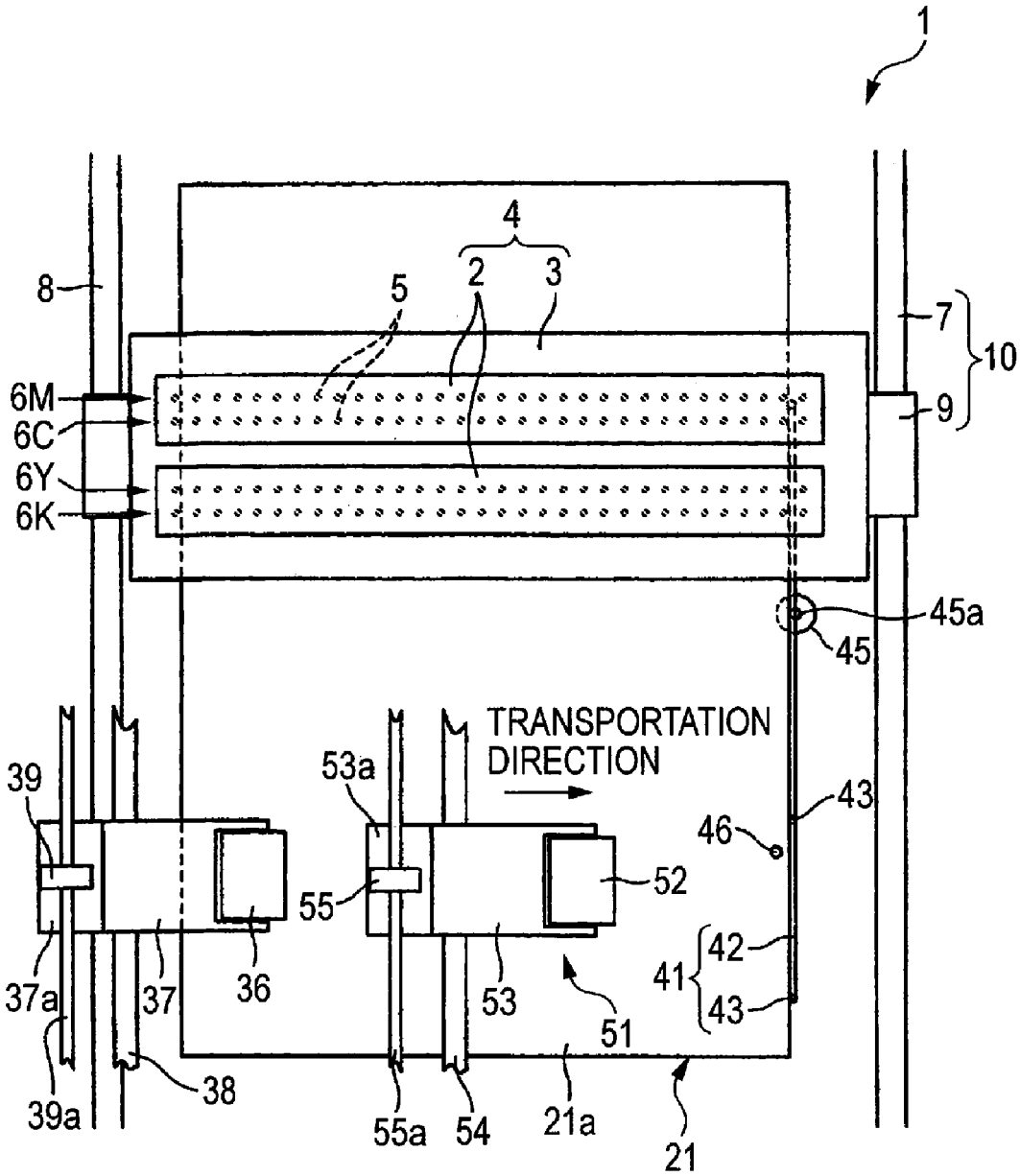
FIG. 2 is a partial plan view of the interior of the inkjet printer shown in FIG. 1.

FIG. 1 is a configuration diagram showing an inkjet printer according to an aspect of the invention, and FIG. 2 is a partial plan view of the interior of the inkjet printer shown in FIG. 1. As shown in FIGS. 1 and 2, the inkjet printer 1 is a line-type color inkjet printer having two long inkjet heads 2 which are laterally extended. Referring to FIG. 1, in the printer 1, a sheet housing portion 14 which houses plural sheets P is disposed in the lower side, a sheet discharge tray 15 in the upper side, and a platen (holding member) 21 which holds the sheet P, in the middle side. In the printer 1, moreover, a moving mechanism (first moving mechanism) 11 which moves the inkjet heads 2 and the platen 21 in a direction perpendicular to the transportation direction of the sheet P, a transporting mechanism 12 which transports the sheet P from the sheet housing portion 14 onto the platen 21, a discharging mechanism 13 which discharges the sheet P on the platen 21 to the sheet discharge tray 15, and a controlling section 100 which controls the operations of the mechanisms 11 to 13 are disposed. In this aspect, the moving mechanism 11 is configured by: a head moving mechanism 10 which moves the inkjet heads 2 in a direction perpendicular to the transportation direction; and a platen moving mechanism 70 which moves the platen 21 in a direction perpendicular to the transportation direction.

The transporting mechanism 12 comprises: a pickup roller (feeding unit) 16 which feeds out one by one the sheet P that is the uppermost one of plural sheets P stacked in the sheet housing portion 14; a guiding mechanism 17 which guides the sheet P fed by the pickup roller 16 until the sheet P reaches the platen 21; and a sheet supplying mechanism (transporting unit) 18 which supplies the sheet P that is transported to the platen 21 by the guiding mechanism 17, to a flat upper face (holding face) 21*a* of the platen 21.

The guiding mechanism 17 comprises: a guiding member 35 which extends from the pickup roller 16 to the platen 21 in a bending manner; a pair of feed rollers 31, 32 which are disposed in a midportion of the guiding member 35; and a pair of feed rollers 33, 34 which are disposed in the vicinity of an end portion of the guiding member 35 on the side of the platen 21. The pair of feed rollers 31, 32 transports the sheet P, which is fed into the guiding member 35 by the pickup roller 16, toward the pair of feed rollers 33, 34 while nipping the sheet. The pair of feed rollers 33, 34 transports the sheet P, which is transported by the paired feed rollers 31, 32, toward the platen 21 while nipping the sheet.

As shown in FIGS. 1 and 2, the sheet supplying mechanism 18 comprises: a sheet supply roller (transport roller) 36 which supplies the sheet P that is transported by the guiding mechanism 17, onto the upper face 21*a* of the platen 21; a support member 37 which rotatably supports the sheet supply roller 36; a driving shaft 38 which swingably supports the support member 37; and a cam (displacing unit) 39 which swings the support member 37 while using the driving shaft 38 as a fulcrum. In FIG. 2, the sheet supply roller 36 is placed at a position, which is downward shifted from the middle of the platen 21. This downward shifted placement of the sheet supply roller 36 enables transportation of a sheet having a smallest one of plural sheet sizes, which can be held on the upper face 21*a* of the platen 21. In this aspect, the sheet P to be transported to the upper face 21*a* of the platen 21 is transported so that, in FIG. 2, the lower end of the platen 21 and that of the sheet P surely overlap with each other. A contact portion 37*a* which is in contact with an outer peripheral side face of the cam 39 is formed in an end portion of the support member 37 on the side of the driving shaft 38. The cam 39 is fixed to a rotation shaft 39*a* placed in the vicinity of the outer peripheral side face of the cam 39. When the rotation shaft 39*a* is rotated, the cam 39 is also rotated. The support member 37 incorporates a gear (not shown), which is supported on the driving shaft 38, and two gears (not shown) which transmit the rotational force of the gear. These gears transmit the rotational force of the driving shaft 38 to the sheet supply roller 36. Namely, a driving mechanism which provides the transport roller 36 with a rotational force for transporting the sheet P is configured by the driving shaft 38 and the two gears. In this aspect, the driving shaft 38 is rotated in a clockwise direction in FIG. 1, whereby the sheet supply roller 36 is rotated in a counterclockwise direction in FIG. 1. At this time, when the sheet supply roller 36 is in contact with the sheet P and cooperates with the upper face 21*a* to nip the sheet, the sheet P is transported by the rotation of the sheet supply roller 36 so that an end portion of the sheet P on the downstream side in the transportation direction (hereinafter, such an end portion is referred to as "downstream end portion") is directed to a downstream end portion of the upper face 21*a*. The transportation direction is a direction from the left side to the right side in FIGS. 1 and 2.

The discharging mechanism 13 comprises: a removing mechanism (medium removing mechanism) 51 which removes the sheet P held on the upper face 21*a* of the platen 21, from the upper face 21*a*; and a guiding mechanism 57 which guides the sheet P removed by the removing mechanism 51 to the sheet discharge tray while transporting the sheet. As shown in FIGS. 1 and 2, the removing mechanism 51 comprises: a sheet discharge roller 52 which transports the sheet P held on the upper face 21*a* toward the downstream side in the transportation direction; a support member 53 which rotatably supports the sheet discharge roller 52; a driving shaft 54 which swingably supports the support member 53; and a cam 55 which swings the support member 53 while using the driving shaft 54 as a fulcrum. The sheet discharge roller 52 is placed in the same positional relationship as that of the sheet supply roller 36. A contact portion 53*a*, which is in contact with an outer peripheral side face of the cam 55, is formed in an end portion of the support member 53 on the side of the driving shaft 54. The cam 55 is fixed to a rotation shaft 55*a* placed in the vicinity of the outer peripheral side face of the cam 55. In the same manner as the cam 39, when the rotation shaft 55*a* is rotated, the cam 55 is also rotated. In the same manner as the support member 37, the support member 53 incorporates a gear (not shown), which is supported on the driving shaft 54, and two gears (not shown) which transmit the rotational force of the gear. These gears transmit the rotational force of the driving shaft 54 to the sheet discharge roller 52. As seen also from FIGS. 1 and 2, the removing mechanism 51 is configured in a substantially same manner as the members constituting the sheet supplying mechanism 18, and placed in juxtaposition with the sheet supplying mechanism 18 along the transportation direction. The removing mechanism discharges the sheet P held on the platen 21 in the downstream side of the transportation direction while removing the sheet from the upper face 21*a*. By contrast, the sheet supplying mechanism 18 supplies the sheet P to the platen 21.

The guiding mechanism 57 comprises: a guiding member 58 which extends from the vicinity of the downstream end portion of the platen 21 to the sheet discharge tray 15 in a bending manner; a pair of feed rollers 61, 62 which are disposed in the vicinity of an end portion of the guiding member 58 on the side of the platen 21; and a pair of feed rollers 63, 64 which are disposed in the vicinity of an end portion of the guiding member 58 on the side of the sheet discharge tray 15. The pair of feed rollers 61, 62 transport the sheet P, which is fed from the platen 21 by the removing mechanism 51, into the guiding member 58 while nipping the sheet. By contrast, the pair of feed rollers 63, 64 discharge the sheet P, which is transported by the paired feed rollers 61, 62, toward the sheet discharge tray 15 while nipping the sheet.

Figure 3A:
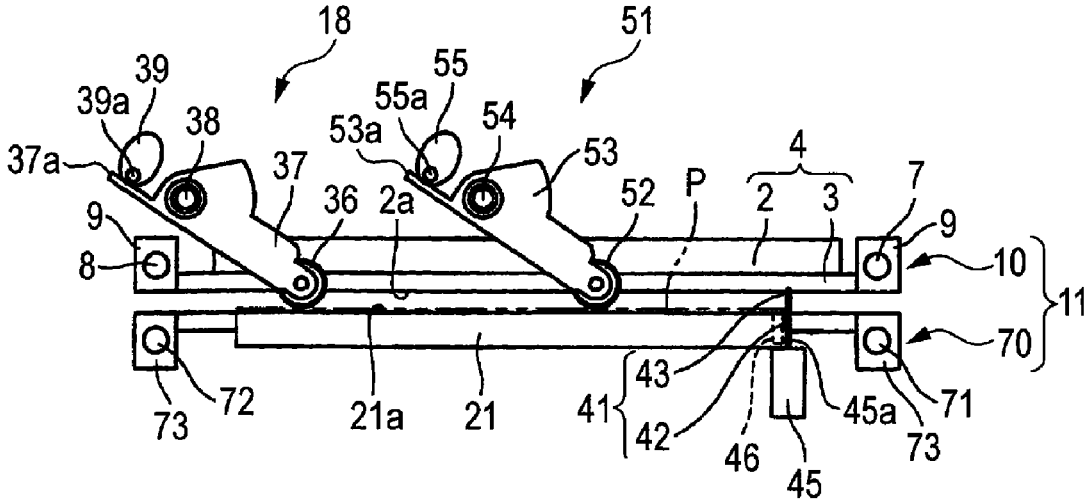
FIGS. 3A and 3B are views showing operating statuses of a sheet supplying mechanism and a removing mechanism.
Figure 3B:
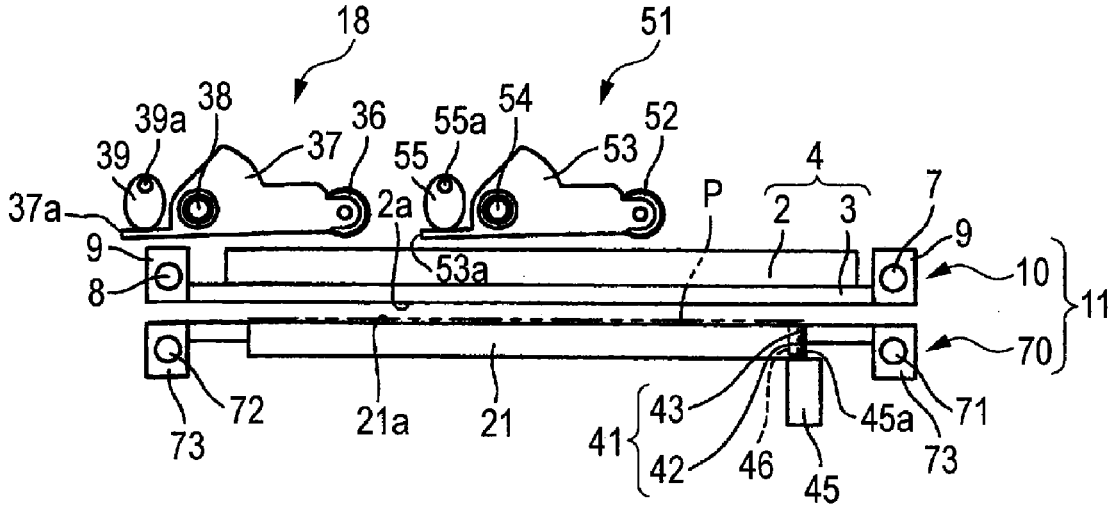

FIGS. 3A and 3B are views showing the operating statuses of the sheet supplying mechanism 18 and the removing mechanism 51. In the sheet supplying mechanism 18 and the removing mechanism 51, as shown in FIGS. 3A and 3B, when the rotations of the two cams 39, 55 are controlled by the controlling section 100, the contact portions 37*a*, 53*a* swing in a direction along which they approach or separate from the rotation shaft 39*a*, 55*a* while using the driving shafts 38, 54 as fulcrums. When both the contact portions 37*a*, 53*a* are closest to the rotation shaft 39*a*, 55*a*, the sheet supply roller 36 and sheet discharge roller 52 which are disposed in the support members 37, 53 are located at positions (i.e., the positions indicated in FIG. 3A) where the rollers are in contact with the sheet P on the upper face 21*a* of the platen 21. By contrast, when both the contact portions 37*a*, 53*a* are remotest from the rotation shaft 39*a*, 55*a*, the sheet supply roller 36 and sheet discharge roller 52 which are disposed in the support members 37, 53 are located at positions (i.e., the positions indicated in FIG. 3B) in which the rollers are separated from the sheet P, or which are above the inkjet heads 2. The placement in which the sheet supply roller 36 and the sheet discharge roller 52 are located above the inkjet heads 2 prevents the rollers from interfering with movement of the inkjet heads 2 which will be described later. In other words, the inkjet heads 2 do not interfere with the rollers 36, 52.

Figure 4A:
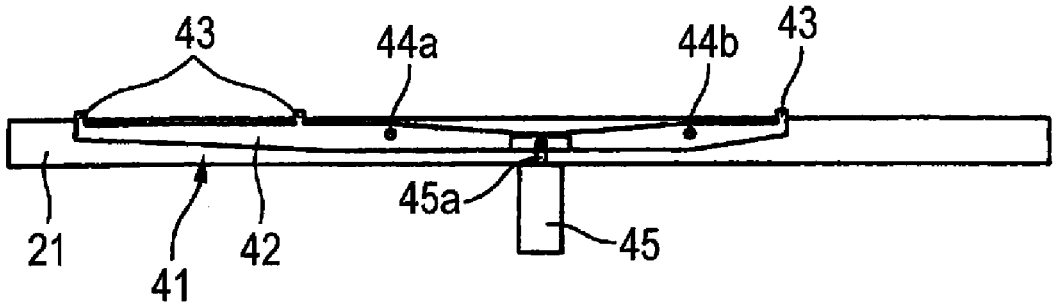
FIGS. 4A and 4B are views showing an operating status of a stopper.
Figure 4B:
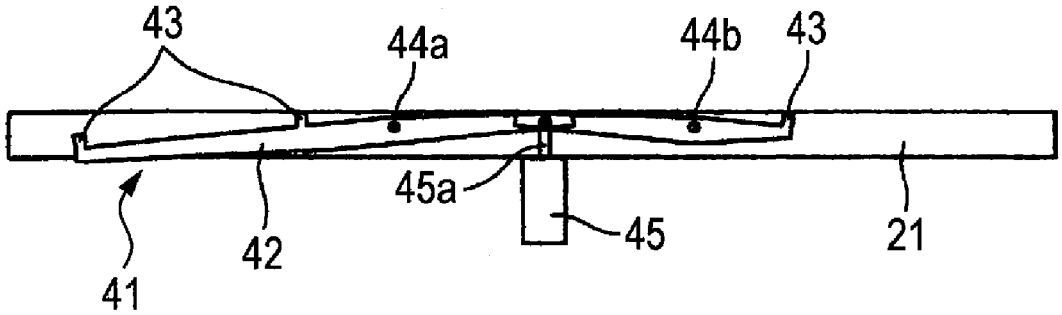

The platen 21 incorporates an electrode (not shown). When a DC voltage is applied to the electrode, the platen itself is charged to attract the sheet P, which is supplied to the upper face 21*a*. A stopper (positioning unit) 41 which is to be in contact with the downstream end portion of the sheet P supplied by the sheet supplying mechanism 18 to position the sheet is disposed on the side face of the downstream end portion of the platen 21. The stopper 41 will be described in detail. FIGS. 4A and 4B are views showing the operating status of the stopper 41. As shown in FIGS. 4A and 4B, the stopper 41 comprises a basal portion 42 which is extended along the downstream end portion of the platen 21, and three projections 43 projected from the upper face of the basal portion 42. The projections 43 are disposed at the both ends of the basal portion 42 in the direction perpendicular to the transportation direction, and a position which is shifted from the middle to the left side, respectively. The basal portion 42 is supported on the platen 21 by a fixing pin 44*a* placed in a substantially middle portion of the basal portion 42, and a fixing pin 44*b* placed at a position which is shifted from the middle to the right side. Furthermore, the basal portion 42 is fixed to the tip end of a cylinder 45*a* of a solenoid 45 at a substantially middle of the two fixing pins 44*a*, 44*b*. According to this configuration, when the cylinder 45*a* of the solenoid 45 contracts, as shown in FIG. 4A, a projected position where the tip end portions of the three projections 43 are projected from the upper face 21*a* of the platen 21 is taken, and a state where positioning with respect to the sheet P is enabled is set. By contrast, when the cylinder 45*a* of the solenoid 45 extends, as shown in FIG. 4B, a retracted position where the three projections 43 are not projected from the upper face 21*a* of the platen 21 is taken in accordance with deformation of the basal portion 42, and a state where the positioning-enabled state for the sheet P is cancelled is set.

As shown in FIG. 2, a sensor (detecting means) 46, which detects the sheet P is disposed at a position in the vicinity of the stopper 41 of the platen 21, is disposed on the upstream side of the stopper 41 in the transportation direction. The sensor 46 is placed at a position where the sensor overlaps with a strip-like area of the sheet P, which is transported to the upper face 21*a*, in the direction perpendicular to the plane of the paper in FIG. 2. The strip-like area is in contact with and extends from the sheet supply roller 36. Therefore, it is possible to detect even a sheet having a smallest one of plural sheet sizes, which can be held on the upper face 21*a* of the platen 21.

Figure 5:
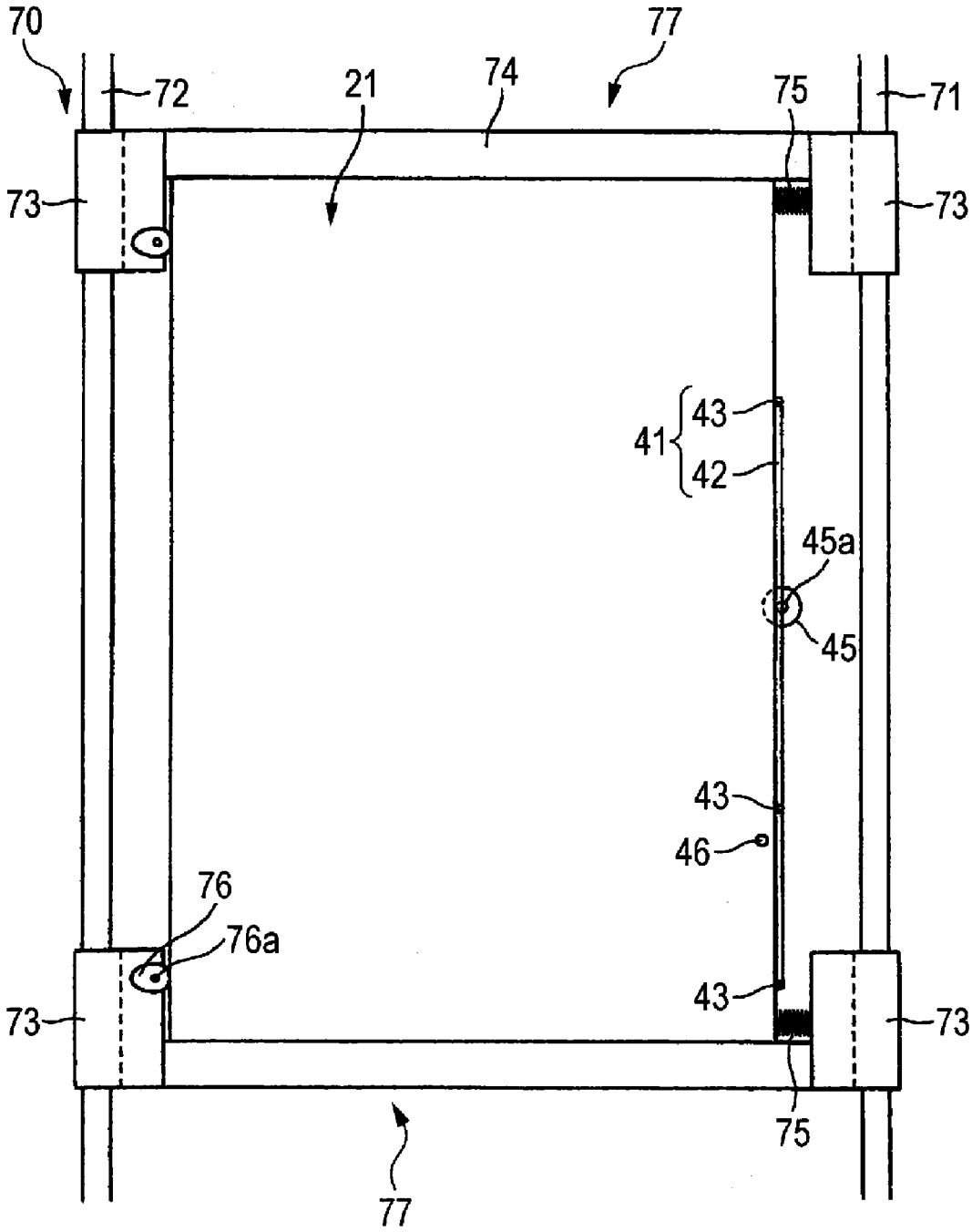
FIG. 5 is a partial plan view showing a platen of the inkjet printer and the periphery thereof.
Figure 6A:
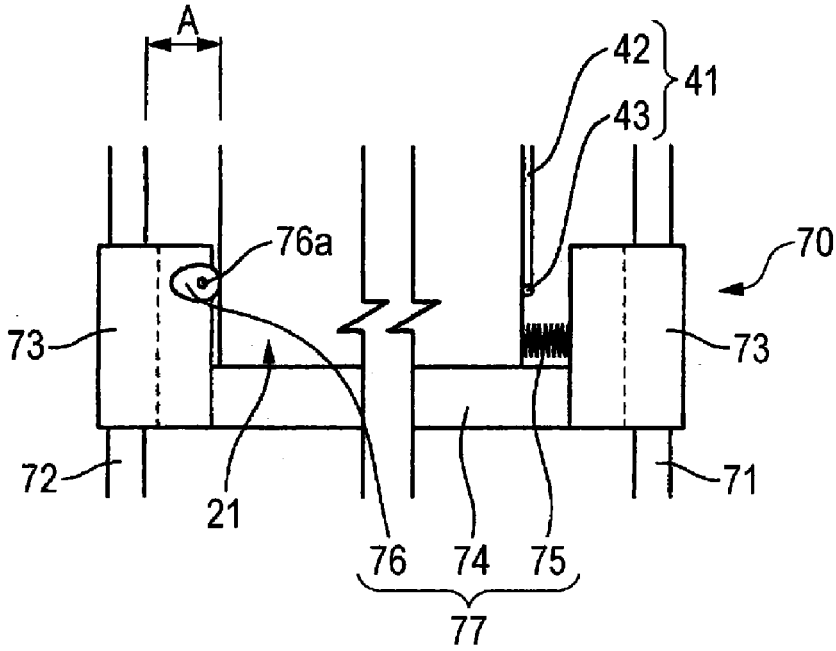
FIGS. 6A and 6B are view showing an operating status of the platen.
Figure 6B:
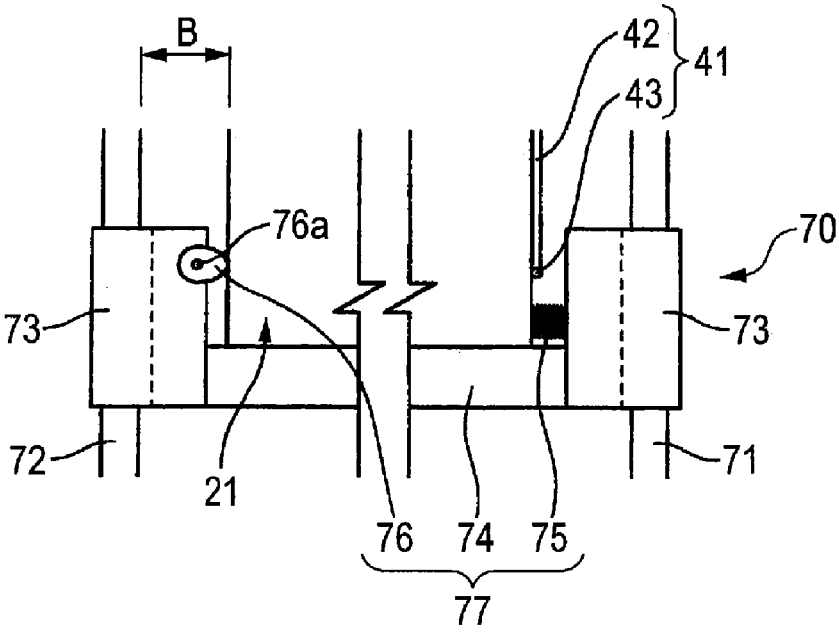

FIG. 5 is a partial plan view showing the platen 21 of the inkjet printer and the periphery thereof, and FIGS. 6A and 6B are views showing the operating status of the platen 21. As shown in FIG. 5, the platen 21 has a rectangular plan shape in which the longitudinal direction is perpendicular to the transportation direction. The platen moving mechanism 70 comprises: a pair of rails 71, 72 which extend in the vicinities of the both ends of the platen 21 and in parallel with the longitudinal direction; and four linear motors 73 two of which are disposed in each of the rails 71, 72, and which move on the rails 71, 72. The linear motors 73 disposed on the rail 71, and those disposed on the rail 72 are coupled together by two coupling members 74. The two coupling members 74 which couple the linear motors 73 together are placed so as to sandwich the platen 21, and support the platen 21 on their inner side faces so that the platen is slidable in a direction parallel to the transportation direction. Springs 75 are disposed between the two linear motors 73 disposed on the rail 71 and the platen 21, respectively. The platen 21 is urged by the springs 75 toward the left side in FIG. 5. Cams 76 are disposed between the two linear motors 73 disposed on the rail 72 and the platen 21, respectively. The cams 76 are rotated while using shafts 76*a* which are formed at positions shifted from the centers of the cams 76, as fulcrums, whereby the platen 21 urged by the two springs 75 are moved in a direction parallel to the transportation direction. The cams 76 are constructed such that, when the distance between the upstream end face of the platen 21 and the rail 72 is the minimum distance A as shown in FIG. 6A, the platen 21 is at the initial position. The initial position of the platen 21 is a position where the sheet P is transported to the upper face 21*a* of the platen 21 and the sheet P is removed from the platen 21. When the cams 76 are rotated by 180° from the state shown in FIG. 6A, the distance between the upstream end face of the platen 21 and the rail 72 is the maximum distance B as shown in FIG. 6B. The difference between the maximum distance B and the minimum distance A is a moving distance by which the platen 21 is to be moved, and equal to one half of the nozzle interval in the inkjet heads 2 with respect to the transportation direction. In this aspect, a fine-adjustment mechanism (second moving mechanism) 77 which finely moves the platen 21 in parallel with the transportation direction is configured by the two cams 76, the two springs 75, and the coupling members 74. According to the configuration, when the rotations of the cams 76 are controlled by the controlling section 100, the platen 21 can be moved (second movement) in a direction parallel to the transportation direction, and, when the linear motors 73 are controlled so as to be moved on the rails 71, 72, the platen 21 can be moved (first movement) in a direction perpendicular to the transportation direction.

As shown in FIGS. 1 and 2, the two inkjet heads 2 are arranged in the direction perpendicular to the transportation direction, and fixed to a frame 3, thereby constituting one head unit 4. Plural nozzle 5 are arranged in the transportation direction in faces (i.e., ink ejection faces) 2*a* of the inkjet heads 2 which are opposed to the platen 21, so that two nozzle rows 6 are formed in each of the inkjet heads.

As shown in FIG. 2, the plural nozzles 5 constituting each nozzle row 6 are arranged in the transportation direction at equal intervals which correspond to a predetermined resolution. The nozzles 5 which are positioned respectively at the both ends of each nozzle row 6 are placed in the outside which is not opposed to the sheet P of the largest size that can be held by the platen 21, so that borderless printing can be performed on the sheet P of any one of plural sizes which can be held by the platen 21. Even when the platen 21 is further moved by one half of the nozzle interval in the transportation direction as described above, borderless printing can be surely performed on the sheet P because the nozzles 5 exist at positions which are opposed to the outside of the sheet P in the transportation direction. Furthermore, the positioning of the sheet P on the upper face 21*a* of the platen 21 with respect to the transportation direction can be performed while leaving a margin (allowance), because, even when the sheet P on the upper face 21*a* is slightly deviated from the positioning position due to the stopper 41 with respect to the transportation direction, the nozzles 5 exist at positions which are opposed to the both ends of the sheet P in the transportation direction. In this aspect, the nozzles 5 eject inks of different colors depending on the nozzle rows 6. Namely, in the downward sequence starting from the nozzle row 6 which is uppermost located in FIG. 2, the nozzles of respective rows ejects inks of magenta, cyan, yellow, and black.

The resolution corresponding to the nozzle interval in the inkjet head 2 is determined by the distance between intersections of a virtual line segment extending in the transportation direction and plural straight lines which extend in parallel to one another from the centers of plural nozzles 5 so as to be perpendicular to the virtual line segment (the line segment and the straight lines are not shown). In this aspect, one nozzle row is formed for each color, and the plural nozzles 5 in each nozzle row 6 are arranged in a straight line in parallel to the transportation direction. Therefore, the distance (nozzle interval) between the nozzles 5 with respect to the transportation direction coincides with the resolution of the inkjet head 2. In the case where plural nozzles for each color are arranged in a staggered pattern to constitute plural nozzle rows, one half of the distance between intersections of a virtual line segment and plural straight lines which extend from the nozzles in parallel to one another and perpendicular to the virtual line segment is equal to the moving distance in the transportation direction.

The head moving mechanism 10 comprises: a pair of rails 7, 8 which extend in the vicinity of the both ends of the head unit 4 in a direction perpendicular to the transportation direction and in parallel to the perpendicular direction; and linear motors 9 which are disposed respectively on the rails 7, 8 and which move on the rails 7, 8. The linear motors 9 are fixed to the frame 3 of the head unit 4. According to the configuration, the linear motors 9 are controlled by the controlling section 100 so as to move on the rails 7, 8, whereby the head unit 4 (two inkjet head 2) can be moved (first movement) in a direction perpendicular to the transportation direction.

Figure 7:
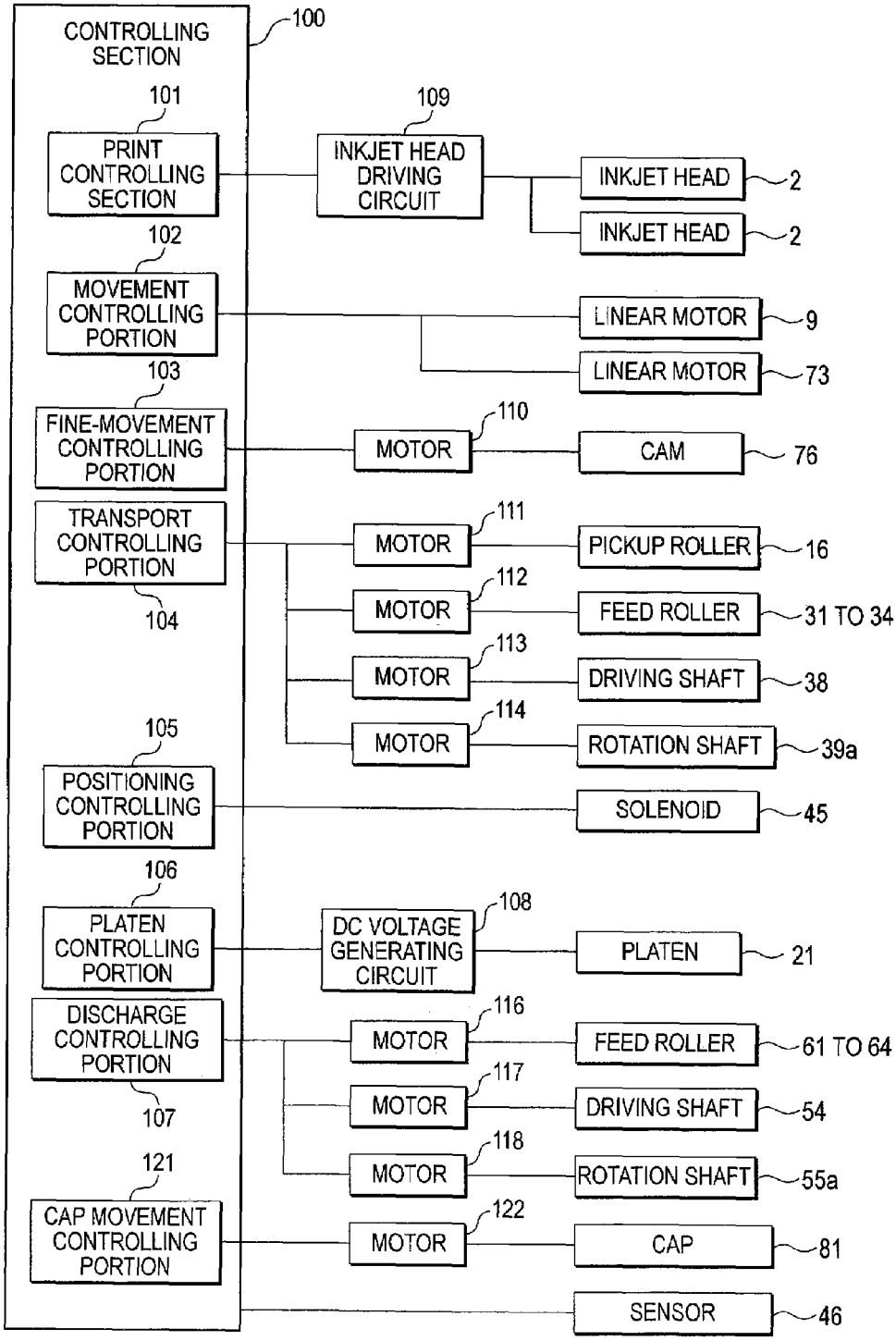
FIG. 7 is a functional block diagram of a controlling section shown in FIG. 1.

Next, the controlling section 100 will be described. FIG. 7 is a functional block diagram of the controlling section 100 shown in FIG. 1. The controlling section 100 has: a CPU (Central Processing Unit) which is an arithmetic processing unit; a ROM (Read Only Memory) which stores programs to be executed by the CPU and data to be used by the programs; a RAM (Random Access Memory) which temporarily stores data during execution of a program; and other logic circuits. These components integrally function to construct functional portions which will be described below.

As shown in FIG. 7, the controlling section 100 comprises a print controlling portion (print controlling unit) 101, a movement controlling portion (first movement controlling unit) 102, a fine-movement controlling portion (second movement controlling unit) 103, a transport controlling portion (transport controlling unit) 104, a positioning controlling portion (positioning controlling unit) 105, a platen controlling portion 106, a discharge controlling portion (medium removal controlling mechanism) 107, and a cap movement controlling portion 121. The sensor 46 disposed on the platen 21 is connected to the controlling section 100 and detects whether the sheet P exists on the upper face 21*a* of the platen 21 or not. The print controlling portion 101 controls an inkjet head driving circuit 109 on the basis of image data received by the controlling section 100, to cause plural nozzles 5 of the inkjet head 2 to eject the inks. Based on instructions from the print controlling portion 101, the inkjet head driving circuit 109 supplies an ejection signal to plural actuators (not shown) disposed in the inkjet head 2. The actuators to which the ejection signal is supplied applies a pressure to the inks in the inkjet head 2 so that the inks are ejected from the nozzles 5. In this way, the inks are ejected from the inkjet head 2.

The movement controlling portion 102 drive-controls the linear motors 9 of the head moving mechanism 10 and the linear motors 73 of the platen moving mechanism 70 to move the linear motors 9, 73 on the corresponding rails 7, 8, 71, 72. The fine-movement controlling portion 103 drive-controls a motor 110 which rotates the shafts 76*a*, to cause the two cams 76 to be simultaneously rotated, whereby the platen 21 is moved from the initial position in the transportation direction by one half of the distance corresponding to the resolution of the inkjet head 2, and thereafter the platen 21 is moved to the initial position. The transport controlling portion 104 drive-controls a motor 111 which drives the pickup roller 16, a motor 112 which drives the feed rollers 31 to 34, a motor 113 which rotates the driving shaft 38, and a motor 114 which rotates the rotation shaft 39*a*, to supply the sheet P from the sheet housing portion 14 to the upper face 21*a* of the platen 21. The positioning controlling portion 105 drive-controls the solenoid 45 to move the projections 43 of the stopper 41 to the projected position where the projections are projected from the upper face 21*a* of the platen 21, or the retracted position where the projections are not projected from the upper face 21*a*. The platen controlling portion 106 controls a DC voltage generating circuit 108 which applies the DC voltage to the internal electrode of the platen 21, thereby causing the platen 21 to hold the sheet P supplied to the upper face 21*a* of the platen 21, or canceling the holding of the sheet P. The discharge controlling portion 107 controls a motor 116 which drives the feed rollers 61 to 64, a motor 117 which rotates the driving shaft 54, and a motor 118 which rotates the rotation shaft 55*a*, to discharge the sheet P on which an image is formed, and which is on the upper face 21*a* of the platen 21, to the sheet discharge tray 15. The cap movement controlling portion 121 controls a motor 122 functioning as a driving source for a cap moving mechanism for moving a cap 81 which will be described later, whereby the cap 81 is moved via the cap moving mechanism (not shown) to a position where the cap is in contact with an ejection face 2*a* of the inkjet head 2, or that where the cap is separated from the ejection face. As shown in FIG. 7, the printer 1 of this aspect has the plural motors 110 to 114, 116 to 118, 122 which rotate the cams 76, the pickup roller 16, etc. Alternatively, a switching mechanism which transmits the rotational force of a motor may be disposed so that the number of the motors 110 to 114, 116 to 118, 122 is reduced.

Figure 8:
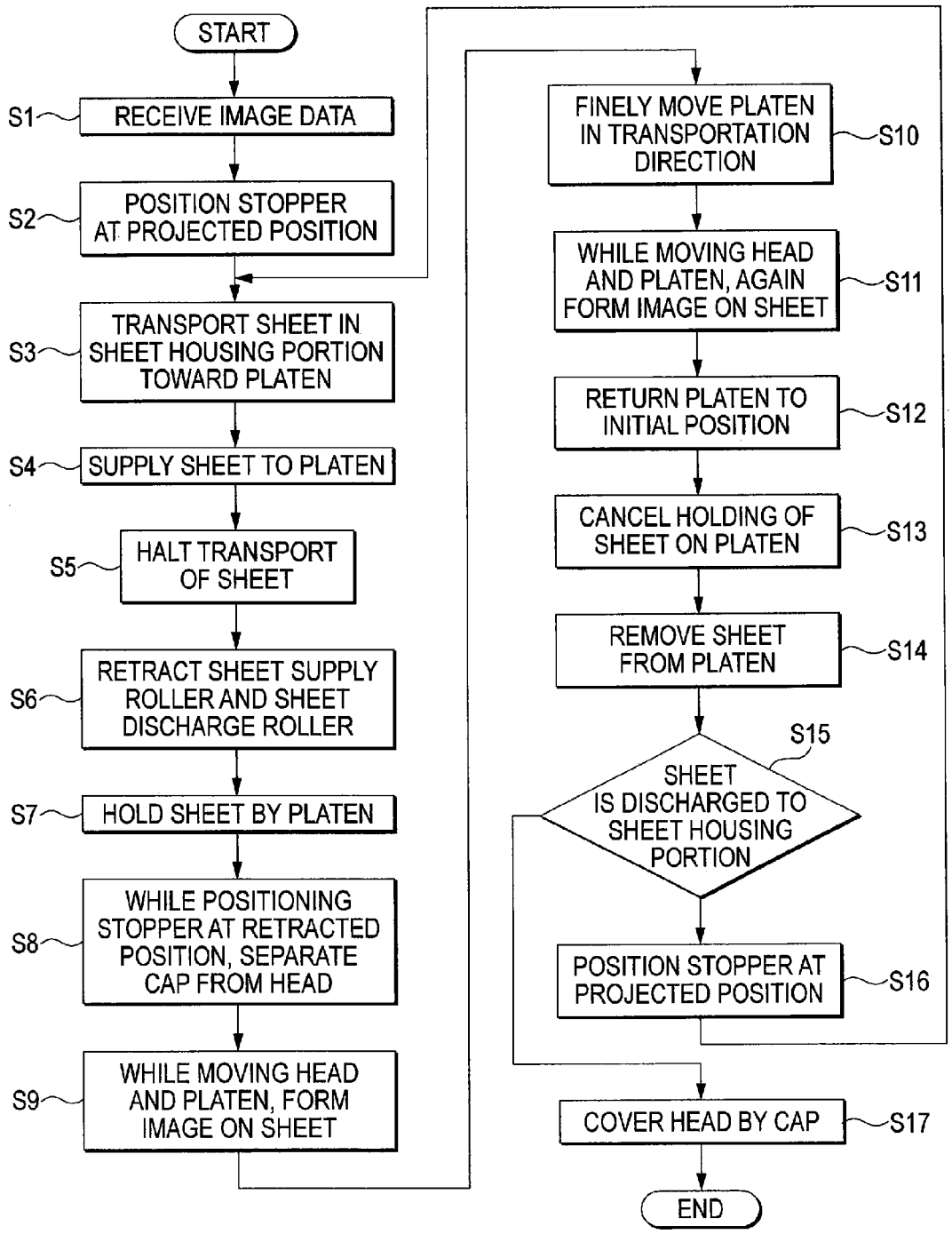
FIG. 8 is a control flow chart of the inkjet printer.
Figure 9A:
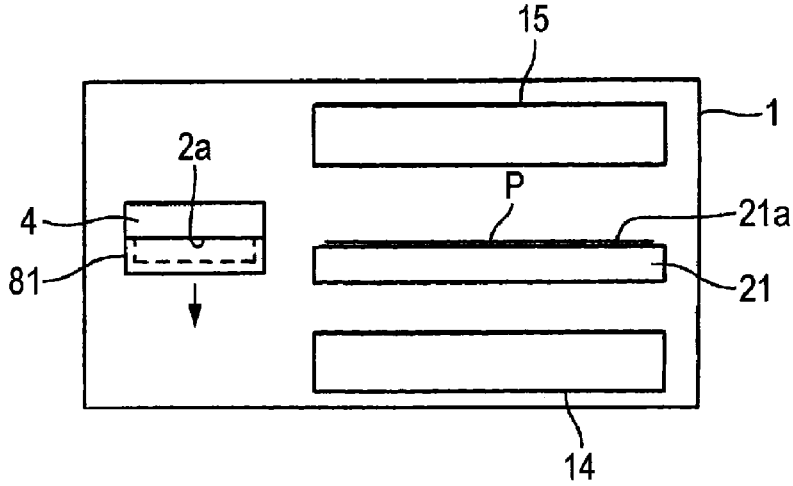
FIGS. 9A to 9C are views showing an operating status in printing of the inkjet printer.
Figure 9B:
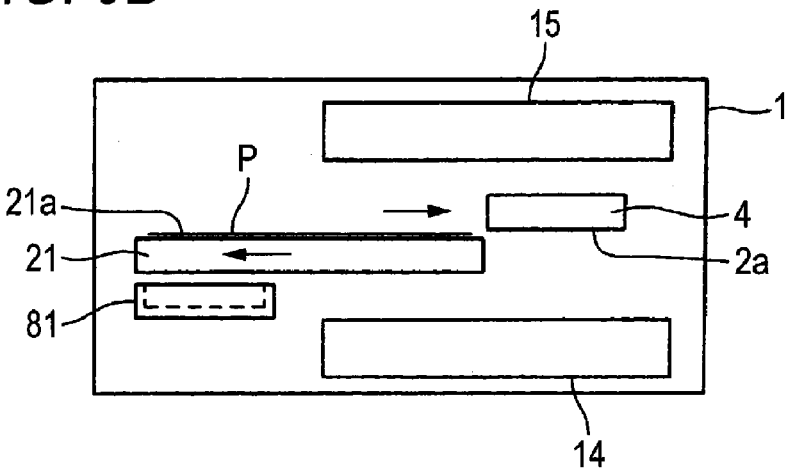
Figure 9C:
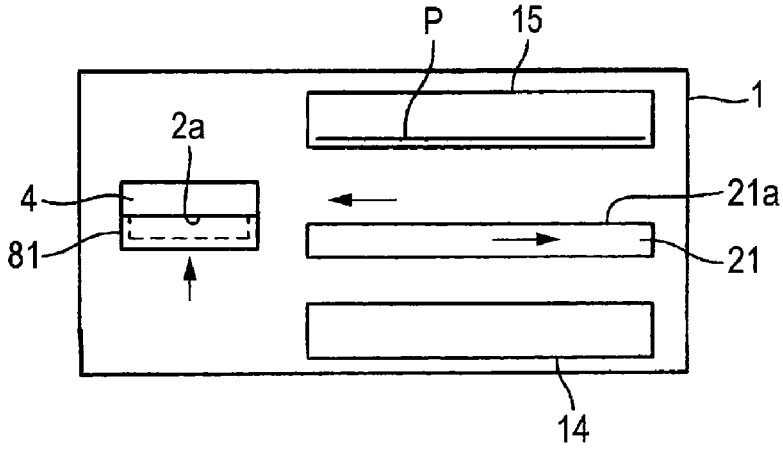

Next, the control flow of the inkjet printer 1 in the case where an image is printed on the sheet P will be described. FIG. 8 is a control flow chart of the inkjet printer, and FIGS. 9A to 9C are views showing the operating status in printing of the inkjet printer. As shown in FIG. 8, in step 1 (S1), the controlling section 100 receives image data for one sheet P. Then, in next step 2 (S2), the positioning controlling portion 105 controls the solenoid 45, whereby the projections 43 of the stopper 41 are positioned so as to take the projected position.

Next, in step 3 (S3), the transport controlling portion 104 drive-controls the motors 111, 112 so that the pickup controller 16 feeds the sheet P in the sheet housing portion 14 into the guiding member 35, and the feed rollers 31 to 34 transport the sheet P fed to the guiding member 35, toward the platen 21.

Next, in step 4 (S4), the transport controlling portion 104 drives the motor 114, and the discharge controlling portion 107 drives the motor 118, whereby the cams 39, 55 are positioned at the rotation position shown in FIG. 3A so that the sheet P transported to the upper face 21*a* of the platen 21 is in contact with the sheet supply roller 36 and the sheet discharge roller 52, and thereafter the driving of the motors 114, 118 is stopped. Then, the transport controlling portion 104 drives the motor 113, and the discharge controlling portion 107 drives the motor 117, whereby the sheet supply roller 36 and the sheet discharge roller 52 are rotated to cause the sheet P which is in contact with the sheet supply roller 36 and the sheet discharge roller 52, to be supplied onto the upper face 21*a* so that the sheet contacts with the stopper 41. In this aspect, when the sheet P is to be supplied to the upper face 21*a* of the platen 21, the sheet supplying operation also uses the removing mechanism 51. Alternatively, the discharge controlling portion 107 may not drive-control the motors 117, 118, and the sheet supplying operation may be performed only by the sheet supplying mechanism 18. Furthermore, since the control of the transport controlling portion 104 causes the sheet supply roller 36 to be in contact with the sheet P and rotated, the sheet P can be transported to the upper face 21*a*.

Next, in step 5 (S5), when the stopper 41 is in contact with the downstream end portion of the sheet P and the sensor 46 detects the downstream end portion of the sheet P, the transport controlling portion 104 and the discharge controlling portion 107 stop the driving of the motors 111 to 113, 117 so as to halt the transport (supply) of the sheet P. As described above, the sensor 46 is disposed in the vicinity of and the upstream side of the stopper 41 of the platen 21, and hence the sheet P can be surely positioned at the predetermined position. In step 6 (S6), the transport controlling portion 104 drives the motor 114, and the discharge controlling portion 107 drives the motor 118, whereby the cams 39, 55 are positioned at the rotation position shown in FIG. 3B so that the sheet supply roller 36 and the sheet discharge roller 52 swing to a position which is higher than the head unit 4 (the position of the sheet supply roller 36 and the sheet discharge roller 52 such as shown in FIG. 3B), and thereafter the driving of the motors 114, 118 is stopped.

Next, in step 7 (S7), the platen controlling portion 106 controls the DC voltage generating circuit 108 so that the platen 21 itself is charged. This causes the sheet P, which is positioned on the upper face 21*a* by the stopper 41, to be held to the platen 21 while maintaining the state.

Next, in step 8 (S8), the positioning controlling portion 105 controls the solenoid 45 to position the projections of the stopper 41 so that the projections take the retracted position. Since the stopper 41 takes the retracted position in this way, the inkjet head 2 and the stopper 41 do not interfere with each other when the inkjet head 2 is moved as described later. Then, the cap movement controlling portion 121 drive-controls the motor 122 so as to downward move the cap 81 which covers the ink ejection face 2*a* of the inkjet head 2, via the cap moving mechanism (not shown) as shown in FIG. 9A. At this time, as shown in FIG. 9B, the cap 81 is moved to a position where it does not interfere with the movement of the platen 21, and thereafter waits at the position. The cap 81 has a recessed shape which is opened toward the ink ejection face 2*a*. In the waiting period when an image is not printed on the sheet P, the inkjet head 2 is set to a capping state where the ink ejection face 2*a* is covered by the cap 81, in order to suppress drying of the inks in the nozzles 8.

Next, in step 9 (S9), the movement controlling portion 102 drives the linear motors 9, 73 so as to cause the head unit 4 and the platen 21 which holds the sheet P, to perform relative movement for a first time in a direction in which they approach each other (the head unit 4 is moved rightward, and the platen 21 is moved leftward) as shown in FIG. 9B. At this time, when the ink ejection face 2*a* of the inkjet head 2 is opposed to the sheet P, the print controlling portion 101 controls the inkjet head driving circuit 109 so as to, on the sheet P, form an image of resolution corresponding to the nozzle interval of the inkjet head 2 with respect to the transportation direction. As shown in FIG. 9B, the head unit 4 and the platen 21 are then moved to respective positions where they are not opposed to each other, 1 and thereafter the movement controlling portion 102 stops the driving of the linear motors 9, 73.

Next, in step 10 (S10), the fine-movement controlling portion 103 drives the motor 110 to rotate the cams 76 by 180°. Then, the platen 21 is moved from the initial position in the transportation direction by a distance which is equal to one half of the nozzle interval of the inkjet head 2 with respect to the transportation direction.

Next, in step 11 (S11), the movement controlling portion 102 drives the linear motors 9, 73 so as to cause the head unit 4 and the platen 21 which holds the sheet P, to perform the relative movement for a second time in a direction in which they approach each other (the head unit 4 is moved leftward, and the platen 21 is moved rightward) as shown in FIG. 9C. The moving directions of the head unit 4 and the platen 21 in the relative movement for the second time are opposite to those in the relative movement for the first time, respectively. At this time, when the ink ejection face 2*a* of the inkjet head 2 is opposed to the sheet P, the print controlling portion 101 controls the inkjet head driving circuit 109 so as to, on the sheet P, form an image of resolution corresponding to the nozzle interval of the inkjet head 2 with respect to the transportation direction. Therefore, one image, in which the image formed in step 9 is combined with that formed in step 11, is formed on the sheet P, with the result that the resolution of the resulting image is twice that corresponding to one half of the nozzle interval of the inkjet head 2 because of the following reason. Each dot of the image formed in the relative movement for the second time is positioned in the middle of the interval of dots which are formed in the relative movement for the first time, and which are adjacent to each other in the transportation direction. As shown in FIG. 9C, the head unit 4 and the platen 21 are moved to respective positions where they are not opposed to each other, and thereafter the movement controlling portion 102 stops the driving of the linear motors 9, 73.

Next, in step 12 (S12), the fine-movement controlling portion 103 drives the motor 110 to rotate the cams 76 by 180°. Then, the platen 21 is moved in the transportation direction by a distance which is equal to one half of the distance corresponding to the resolution of the inkjet head 2, to return to the initial position. As a result, the positional relationship between the inkjet head 2 and the platen 21 with respect to the transportation direction returns to the sate which is obtained before the image is formed on the sheet P.

Next, in step 13 (S13), the platen controlling portion 106 controls the DC voltage generating circuit 108 to stop the charging operation on the platen 21 itself. Therefore, the operation of attracting and holding the sheet P by the platen 21 is canceled.

Next, in step 14 (S14), the transport controlling portion 104 drives the motor 114, and the discharge controlling portion 107 drives the motor 118, whereby the cams 39, 55 are positioned at the rotation position shown in FIG. 3A so that the sheet P on which the image is formed is in contact with the sheet supply roller 36 and the sheet discharge roller 52, and thereafter the driving of the motors 114, 118 is stopped. Then, the transport controlling portion 104 drives the motor 113, and the discharge controlling portion 107 drives the motor 117, whereby the sheet supply roller 36 and the sheet discharge roller 52 are rotated to cause the sheet P to be removed from the upper face 21*a* of the platen 21 and transported into the guiding member 58. In this aspect, when the sheet P is to be removed from the upper face 21*a* of the platen 21, the sheet removing operation also uses the sheet supplying mechanism 18. Alternatively, the transport controlling portion 104 may not drive-control the motors 111 to 114, and the sheet removing operation may be performed only by the removing mechanism 51.

Next, in step 15 (S15), the discharge controlling portion 107 drive-controls the motor 116, and the feed rollers 61 to 64 transport the sheet P fed into the guiding member 58, toward the sheet discharge tray 15 to discharge the sheet. In step 15, if the controlling section 100 determines that a further sheet P is to be supplied to the platen 21 and a continuous printing process is to be performed, the process proceeds to step 16 (S16) After the upstream end portion of the sheet P passes the stopper 41, the positioning controlling portion 105 controls the solenoid 45 so that the projections 43 of the stopper 41 are positioned so as to take the projected position. At this time, detection of whether the upstream end portion of the sheet P passes the stopper 41 or not is conducted by the controlling section 100 depending on a signal indicative of detection/undetection of the sheet P from the sensor 46. Namely, the disposition of the sensor 46 enables the check of discharge of the sheet P to be surly conducted. When this discharge check is not conducted, the possibility that the sheet P is jammed in the vicinity of the platen 21 is increased. Then, the process returns to step 3, and steps 3 to 16 are repeatedly conducted during a period when the continuous printing process is performed. If the controlling section 100 determines in step 15 that the continuous printing process is not performed and the printing process is to be terminated, the process proceeds to step 17 (S17).

Next, in step 17, the cap movement controlling portion 121 drive-controls the motor 122 so that the cap 81 is upward moved from the waiting position and the ejection face 2*a* of the inkjet head 2 is covered by the cap 81 as shown in FIG. 9C. Then, the printing process on the sheet P is terminated.

As described above, according to the inkjet printer 1, in step 9, the print controlling portion 101 causes the inkjet head 2 to eject the inks to the sheet P, and an image of resolution corresponding to the nozzle interval of the inkjet head 2 with respect to the transportation direction is formed on the sheet P. In step 10, the sheet P is then moved together with the movement in which the platen 21 is moved by one half of nozzle interval. Therefore, the printing on the sheet P in step 11 is combined with that on the sheet Pin step 9 to obtain an image of resolution which is twice that corresponding to the nozzle interval of the inkjet head 2. Even when the inkjet head 2 is not configured as a head in which the nozzle interval is one half of that of the inkjet head 2, consequently, a high-resolution image can be formed on the sheet P. Moreover, it is possible to prevent the production cost of the inkjet head 2 from being increased.

The movement controlling portion 102 controls the linear motors 9, 73 which move the head unit 4 and the platen 21 in a direction perpendicular to the transportation direction, to move the head unit 4 and the platen 21. As compared with the case where only one of the head unit and the platen is moved, therefore, the relative speed is higher, and hence high-speed printing on the sheet P is enabled. As shown in FIG. 9B, both of the head unit 4 and the platen 21 are moved to attain relative movement. Therefore, the width of the printer 1 in the direction perpendicular to the transportation direction can be reduced. When one of the head unit 4 and the platen 21 is fixed, the other or movable one performs movement which is centered on the fixed one, with the result that the size of the printer is increased.

In the printer 1, the means for positioning the sheet P has the simple configuration including the stopper 41 which can take the projected position and the retracted position with respect to the upper face 21*a* of the platen 21. The disposition of the stopper 41 in the printer 1 enables the sheet P to, when the sheet P is supplied to the upper face 21*a* of the platen 21, be positioned at a predetermined position of the upper face 21*a*. Therefore, the position of the sheet P held on the upper face 21*a* is substantially constant, and hence the accuracy of printing performed by the inkjet head 2 is improved. Since the transportation direction of the sheet P is perpendicular to that of the head unit 4 and the platen 21, the size of the printer 1 in the perpendicular direction can be reduced. The sensor 46 is disposed on the upstream side of the vicinity of the stopper 41 of the platen 21. Therefore, the sheet P can be surely positioned at a predetermined position of the upper face 21*a*.

The printer 1 is provided with the transporting mechanism 12. Even in a miniaturized configuration of the printer 1 such as the case where the platen 21 exists between the sheet housing portion 14 and the head unit 4, therefore, the sheet P can be surely supplied from the sheet housing portion 14 to the upper face 21*a* of the platen 21. Since the discharging mechanism 13 is formed in the printer 1, the sheet P held on the platen 21 can be removed from the upper face 21*a* to be discharged.

Figure 10:
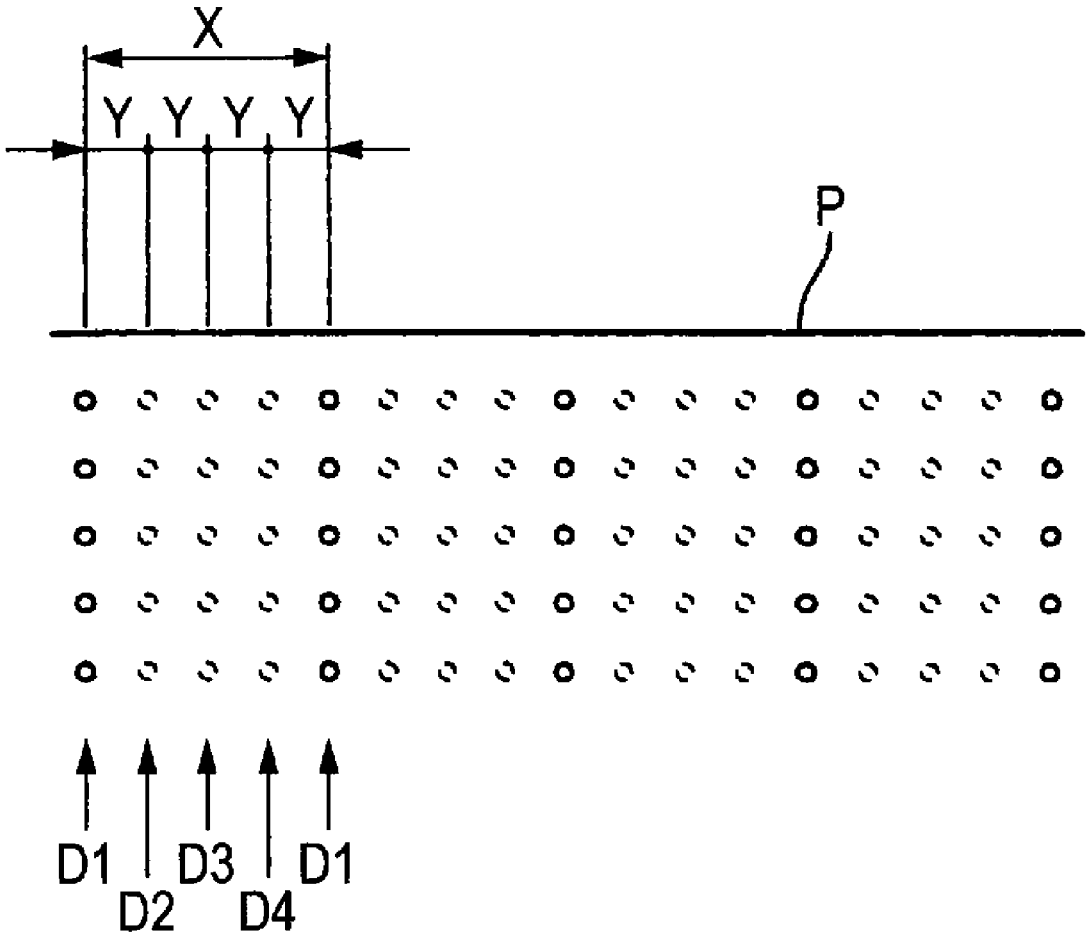
FIG. 10 is a partial plan view of a sheet on which printing is performed in a relative movement for a first time in another aspect of the invention.

The fine-movement controlling portion 103 in this aspect controls the rotation of the motor 110 so that the cams 76 for moving the platen 21 cause the distance between the upstream end face of the platen 21 and the rail 72 to have one of the minimum distance A and the maximum distance B. Alternatively, the cams 76 may be variably moved from the minimum distance A while setting the nozzle interval as the maximum movable distance. In this modification, as shown in FIG. 10, the fine-movement controlling portion controls the motor 110 to rotate the cams 76 in the following manner. The platen 21 is moved in the same direction along the transportation direction by a distance Y, which is obtained by quadrisecting a distance X between plural dots D1 after respective relative movements of the inkjet head 2 and the platen 21 for first, second, and third times. The dots D1 are printed on the sheet P at the initial position of the platen 21 (i.e., when the distance caused by the cams 76 between the upstream end face of the platen 21 and the rail 72 is the minimum distance A). Namely, after the plural dots D1 are formed on the sheet P in the relative movement for the first time, the platen 21 is moved by the distance Y in the rightward direction in FIG. 10, and then plural dots D2 are formed on the sheet P in the relative movement for the second time. Thereafter, the platen 21 is moved by the distance Y in the rightward direction in FIG. 10, and then plural dots D3 are formed on the sheet P in the relative movement for the third time. Thereafter, the platen 21 is moved by the distance Y in the rightward direction in FIG. 10, and then plural dots D4 are formed on the sheet P in the relative movement for a fourth time. In the above-described aspect, the distance X between the dots D1 corresponds to four times the distance Y, and therefore, after the plural dots D1 are formed on the sheet P in the relative movement for the first time, the platen 21 is moved by twice the distance Y in the rightward direction in FIG. 10, and then the dots D3 are formed in the relative movement for the second time, thereby ending the printing process on the sheet P. In this modification, on the other hand, the number of printing operations on the sheet P is increased by two (two printing operations for forming the dots D2, D4), and hence a prolong time period is required for forming an image on one sheet P and discharging the sheet. However, an image of resolution which is four times the resolution corresponding to the nozzle interval of the inkjet head 2 can be formed on the sheet P. Therefore, the resolution of an image formed on the sheet P is improved more than that in the above-described aspect. In the modification, the platen 21 is sequentially moved at the step of the distance Y by the cams 76 in the same direction along the transportation direction. Alternatively, after the inkjet head 2 and the platen 21 are relatively moved for the first time, the platen 21 may be moved by thrice the distance Y in the rightward direction in FIG. 10. In this alternative, after the relative movement for the second time, the platen 21 is moved by the distance Y or by twice the distance Y in the leftward direction in FIG. 10. In the case where the platen 21 is moved by the distance Y in the leftward direction in FIG. 10 after the relative movement for the second time, the platen 21 is moved by the distance Y in the leftward direction in FIG. 10 after the relative movement for the third time. By contrast, in the case where the platen 21 is moved by twice the distance Y in the leftward direction in FIG. 10 after the relative movement for the second time, the platen 21 is moved by the distance Y in the rightward direction in FIG. 10 after the relative movement for the third time. In this way, the fine movement of the platen 21 may be selected as far as the movement direction is in parallel to the transportation direction and may include a movement(s) in the same or opposite direction. In the case where the fine movement of the platen 21 is sequentially performed in the same direction, however, the control of the fine-movement controlling portion is more facilitated.

Although the aspects of the invention has been described, the invention is not restricted to the above-described aspects, and various modifications may be made within the scope of the claims. In the above-described aspect, for example, the nozzles 5 which are positioned respectively at the both ends of the nozzle rows 6 are opposed to the outsides of the both ends of the sheet P in the transportation direction. In a printer which does not perform borderless printing on the sheet P, the outsides of the both ends of the sheet P in the transportation direction may not be opposed to the nozzles. The moving mechanism 11 configured by: the head moving mechanism 10 which moves the head unit 4 in a direction perpendicular to the transportation direction; and the platen moving mechanism 70 which moves the platen 21 in a direction perpendicular to the transportation direction is disposed in the printer 1. Alternatively, the moving mechanism may be configured by one of the head moving mechanism 10 and the platen moving mechanism 70. The movement controlling portion 102 may drive-control the linear motors 9, 73 so that only one of the head unit 4 and the platen 21 is moved in a direction perpendicular to the transportation direction. The transporting mechanism may have any configuration as far as it can supply the sheet P onto the platen 21. Namely, the cam 39 and the like such as in the sheet supplying mechanism 18 may not be disposed. The stopper 41 may not be disposed. The positioning unit for positioning the sheet P on the platen 21 may be formed by a configuration other than the stopper. The sensor 46 may not be disposed in the platen 21. The transportation direction of the sheet P may coincide with the moving directions of the head unit 4 and the platen 21. In the platen 21, the sheet P is held by charging the platen itself. Alternatively, plural suction ports may be formed in the platen, and the sheet P may be held by sucking the sheet through the suction ports. Namely, the manner of holding the sheet P on the platen 21 is not particularly restricted. In the aspect, the sheet P is supplied onto the platen 21 by the sheet supplying mechanism 18. Alternatively, the sheet P may be held and transported by a transportation belt which is looped around two rollers, in place of the platen 21. In the alternative, it is not necessary to dispose the sheet supplying mechanism 18. Only one of the sheet supplying mechanism 18 and the removing mechanism 51 may be disposed in the printer 1. In this case, the configuration of the printer is simplified, and the two operations of supplying the sheet P onto the platen 21 and removing the sheet P from the platen 21 are performed by the disposed one of the sheet supplying mechanism 18 and the removing mechanism 51.

What is claimed is:

1. An inkjet recording apparatus comprising:

a holding member including a holding face which holds a recording medium;

an inkjet head including a plurality of nozzles, which are arranged along a predetermined direction correspondingly with a predetermined resolution on an ink ejection face opposed to the holding face, the ink ejection face has a rectangular shape in which a longitudinal direction is parallel to the predetermined direction;

a first moving mechanism which performs a first movement of moving at least one of the inkjet head and the holding member in a direction perpendicular to the predetermined direction;

a second moving mechanism which performs a second movement of moving the holding member in the predetermined direction;

a first movement controlling unit which controls the first moving mechanism to, during a printing operation on one recording medium, perform the first movement two times including first and second times, in the second time the inkjet head and the holding member being moved in directions that are opposite to directions in the first time;

a second movement controlling unit which controls the second moving mechanism to, during the printing operation on one recording medium and after the first movement for the first time, perform the second movement by a distance which is one half of a distance corresponding to the predetermined resolution; and a print controlling unit which, during the first movement, controls the inkjet head to eject an ink toward the recording medium;

a transporting mechanism which transports the recording medium to the holding face;

a positioning unit which selectively transitions between a positioning-enabled state, where positioning of the recording medium on the holding face is enabled, and a positioning-canceled state;

a detecting unit which, when the positioning unit is in the positioning-enabled state, detects that the recording medium is positioned at a predetermined position by the positioning unit;

a positioning controlling unit which controls the positioning unit to take the positioning-enabled state; and a transport controlling unit which controls the transporting mechanism to transport the recording medium to the holding face, and, when the detecting unit detects that the recording medium is positioned, stops the transport of the recording medium, wherein nozzles, which are positioned respectively at both ends of a nozzle row configured by the plurality of nozzles, are placed outside the recording medium held by the holding member with respect to the predetermined direction, and wherein a direction in which the transporting mechanism transports the recording medium, and the direction in which the first movement of at least one of the inkjet head and the holding member is performed by the first moving mechanism are perpendicular to each other in a plan view in a direction perpendicular to the holding face.

2. The inkjet recording apparatus according to 1, wherein the first moving mechanism comprises: an inkjet head moving mechanism which moves the inkjet head in the direction perpendicular to the predetermined direction; and a holding member moving mechanism which moves the holding member in the direction perpendicular to the predetermined direction, and the first movement controlling unit controls both the inkjet head moving mechanism and the holding member moving mechanism so that the inkjet head and the holding member are relatively moved to approach each other.

3. The inkjet recording apparatus according to 1, wherein the positioning unit includes a stopper which selectively takes a projected position where the stopper is projected from the holding face and a retracted position where the stopper is not projected from the holding face, and which, when the stopper is in the projected position, butts against an end portion of the recording medium, thereby positioning the recording medium.

4. The inkjet recording apparatus according to 3, wherein the detecting unit includes a sensor which detects the recording medium at a detection position, which is on an upstream side of the stopper with respect to a moving direction of the recording medium on the holding face and in a vicinity of the stopper, and which, when the sensor detects that the end portion of the recording medium reaches the detection position, detects that the recording medium is positioned at the predetermined position by the positioning unit.

5. The inkjet recording apparatus according to 1, wherein the transporting mechanism comprises:

a feeding unit which feeds a recording medium from a housing portion which houses recording media, the housing portion being disposed at a position opposed to a face which is opposite to the holding face of the holding member;

a guiding mechanism which guides the recording medium fed out from the housing portion to the holding member; and a transporting unit which transports the recording medium guided by the guiding mechanism to the holding face.

6. The inkjet recording apparatus according to 5, wherein the transporting unit comprises:

a transport roller which is in contact with the recording medium to cooperate with the holding face to nip the recording medium;

a driving mechanism which provides the transport roller with a rotational force for transporting the recording medium;

a support member which displaceably supports the transport roller; and a displacing unit which displaces the support member to selectively position the transport roller to a position where the transport roller is in contact with the recording medium and a position where the transport roller is separated from the recording medium, and the transport controlling unit controls the driving mechanism to provide the transport roller with the rotational force and controls the displacing unit to be positioned at the position where the transport roller is in contact with the recording medium.

7. The inkjet recording apparatus according to 1, wherein the positioning controlling unit controls the positioning unit to take the positioning-canceled state after the recording medium, the transportation of which is stopped by the transport controlling unit, is held on the holding face.

8. The inkjet recording apparatus according to 1, wherein the second movement controlling unit controls the second moving mechanism to, after the first movement for the second time, perform the second movement of returning the holding member to an initial position.

9. The inkjet recording apparatus according to 1, further comprising:

a medium removing mechanism which removes the recording medium from the holding face; and a medium removal controlling unit which controls the medium removing mechanism to, after printing, remove the recording medium from the holding face.

10. An inkjet recording apparatus comprising:

a holding member including a holding face which holds a recording medium;

an inkjet head including a plurality of nozzles, which are arranged along a predetermined direction correspondingly with a predetermined resolution on an ink ejection face opposed to the holding face;

a first moving mechanism which performs a first movement of moving at least one of the inkjet head and the holding member in a direction perpendicular to the predetermined direction;

a second moving mechanism which performs a second movement of moving the holding member in the predetermined direction;

a first movement controlling unit which controls the first moving mechanism to, during a printing operation on one recording medium, perform the first movement two times including first and second times, in the second time the inkjet head and the holding member being moved in directions that are opposite to directions in the first time;

a second movement controlling unit which controls the second moving mechanism to, during the printing operation on one recording medium and after the first movement for the first time perform the second movement by a distance which is one half of a distance corresponding to the predetermined resolution;

a print controlling unit which, during the first movement, controls the inkjet head to eject an ink toward the recording medium;

a transporting mechanism which transports the recording medium to the holding face, the transporting mechanism comprises:

a feeding unit which feeds a recording medium from a housing portion which houses recording media, the housing portion being disposed at a position opposed to a face which is opposite to the holding face of the holding member;

a guiding mechanism which guides the recording medium fed out from the housing portion to the holding member; and a transporting unit which transports the recording medium guided by the guiding mechanism to the holding face, the transporting unit comprises:

a transport roller which is in contact with the recording medium to cooperate with the holding face to nip the recording medium;

a driving mechanism which provides the transport roller with a rotational force for transporting the recording medium;

a support member which displaceably supports the transport roller; and a displacing unit which displaces the support member to selectively position the transport roller to a position where the transport roller is in contact with the recording medium and a position where the transport roller is separated from the recording medium;

a positioning unit which selectively transitions between takes a positioning-enabled state, where positioning of the recording medium on the holding face is enabled, and a positioning-canceled state;

a detecting unit which, when the positioning unit is in the positioning-enabled state, detects that the recording medium is positioned at a predetermined position by the positioning unit;

a positioning controlling unit which controls the positioning unit to take the positioning-enabled state; and a transport controlling unit which controls the transporting mechanism to transport the recording medium to the holding face, and, when the detecting unit detects that the recording medium is positioned, stops the transport of the recording medium, wherein the transport controlling unit controls the driving mechanism to provide the transport roller with the rotational force and controls the displacing unit to be positioned at the position where the transport roller is in contact with the recording medium wherein the displacing unit positions the transport roller at the position where the transport roller is separated from the recording medium to enable the inkjet head to pass between the transport roller and the recording medium.

* * * * *